US010280880B2

(12) United States Patent
Dettinger et al.

(10) Patent No.: US 10,280,880 B2
(45) Date of Patent: May 7, 2019

(54) INTERNAL COMBUSTION ENGINE COMPRISING ATTACHMENT PART

(71) Applicant: Mahle International GmbH, Stuttgart (DE)

(72) Inventors: Marco Dettinger, Pforzheim (DE); Mathias Endress, Stuttgart (DE); Wolfgang Gueth, Stuttgart (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 15/557,753

(22) PCT Filed: Mar. 7, 2016

(86) PCT No.: PCT/EP2016/054783
§ 371 (c)(1),
(2) Date: Sep. 12, 2017

(87) PCT Pub. No.: WO2016/146418
PCT Pub. Date: Sep. 22, 2016

(65) Prior Publication Data

US 2018/0066617 A1 Mar. 8, 2018

(30) Foreign Application Priority Data

Mar. 13, 2015 (DE) ..... 10 2015 204 607

(51) Int. Cl.
*F02M 35/112* (2006.01)
*F02M 35/10* (2006.01)
*F02D 9/10* (2006.01)
*F02D 9/02* (2006.01)

(52) U.S. Cl.
CPC ..... *F02M 35/10085* (2013.01); *F02D 9/106* (2013.01); *F02M 35/10078* (2013.01);
(Continued)

(58) Field of Classification Search
CPC ..... F02M 35/104; F02M 35/10144; F02M 35/10052; F02M 35/10078;
(Continued)

(56) References Cited

U.S. PATENT DOCUMENTS 6,192,849 B1 2/2001 Powell
7,549,377 B2 6/2009 Pabst
(Continued)

FOREIGN PATENT DOCUMENTS

CN 101892927 A 11/2010
CN 202391615 U 8/2012
(Continued)

OTHER PUBLICATIONS

English machine translation provided by ESPACENET of JP 2006063880.*
(Continued)

*Primary Examiner* — Jacob M Amick
*Assistant Examiner* — Michael A Kessler
(74) *Attorney, Agent, or Firm* — Fishman Stewart PLLC

(57) ABSTRACT

An internal combustion engine may include at least one engine block having a plurality of cylinders and at least one flange component. At least one attachment part may be secured to the at least one flange component. An alignment device may be constructed and arranged to align the at least one attachment part relative to the at least one flange component when the at least one attachment part is attached to the at least one flange component. The alignment device may include at least a first alignment unit, a second alignment unit, and a third alignment unit, which may be spaced apart from one another. At least one of the first alignment unit, the second alignment unit, and the third alignment unit may be constructed and arranged to align the at least one attachment part to a cylinder head in relation to a first
(Continued)

aligning direction perpendicular to an attaching direction, when the at least one attachment part is attached to the cylinder head. At least one of the first alignment unit, the second alignment unit, and the third alignment unit may be constructed and arranged to align the at least one attachment part to the cylinder head in relation to a second aligning direction perpendicular to the attaching direction and inclined to the first aligning direction. The at least first alignment unit, the second alignment unit, and the third alignment unit may each be constructed and arranged to align the at least one attachment part to the cylinder head exclusively in one of the first aligning direction or the second aligning direction.

20 Claims, 3 Drawing Sheets

(52) U.S. Cl.
CPC ..... *F02M 35/10354* (2013.01); *F02D 2009/0279* (2013.01); *F02M 35/10144* (2013.01); *F02M 35/112* (2013.01)

(58) Field of Classification Search
CPC ..... F02M 35/10085; F02M 35/112; F02M 35/10354; F02B 31/06
USPC ..... 123/184.21, 184.22, 184.34, 193.5
See application file for complete search history.

(56) References Cited

U.S. PATENT DOCUMENTS

| | | | | |
|---|---|---|---|---|
| 8,220,430 | B2 | 7/2012 | Gupta | |
| 8,464,689 | B2 * | 6/2013 | Born | F02M 35/10085 123/337 |
| 2004/0079348 | A1 | 4/2004 | Mori et al. | |
| 2010/0294226 | A1 | 11/2010 | Gupta | |

FOREIGN PATENT DOCUMENTS

| | | | |
|---|---|---|---|
| DE | 19614314 | A1 | 10/1996 |
| DE | 202004001476 | U1 | 4/2004 |
| DE | 102007017871 | A1 | 1/2008 |
| DE | 102010020875 | A1 | 11/2010 |
| EP | 2778383 | A1 | 9/2014 |
| JP | H05-99087 | A | 4/1993 |
| JP | H08-100723 | | 4/1996 |
| JP | 2006-63880 | A | 3/2006 |
| JP | 2007-507390 | A | 3/2007 |
| JP | 2010-510423 | A | 4/2010 |
| JP | 2011-074859 | A | 4/2011 |
| WO | 2008/061692 | A1 | 5/2008 |

OTHER PUBLICATIONS

English abstract of DE-19614314.
English abstract DE-102007017871.
English abstract for DE-202004001476.
English abstract for CN-202391615.
English abstract for JP-H05-99087.
Japanese Office Action dated Jan. 9, 2018 related to corresponding Japanese Patent Application No. 2017-542079.
Chinese Office Action dated May 3, 2018 related to corresponding Chinese Patent Application No. 201680013242.1.
Japanese Office Action dated May 29, 2018 related to corresponding to Japanese Patent Application No. 2017-542079.

* cited by examiner

INTERNAL COMBUSTION ENGINE COMPRISING ATTACHMENT PART

CROSS-REFERENCE TO RELATED APPLICATIONS

This application claims priority to the International Patent Application No. PCT/EP2016/054783, filed on Mar. 7, 2016, and German Patent Application No. DE 10 2015 204 607.9 filed on Mar. 13, 2015, the contents of each of which are incorporated herein by reference in their entirety.

TECHNICAL FIELD

The present invention relates to an internal combustion engine comprising an attachment part, in particular a suction module. The invention relates in addition to a suction module for such an internal combustion engine.

BACKGROUND

A generic internal combustion engine comprises at least one engine block which contains a plurality of cylinders, and at least one cylinder head, which is fastened to the engine block and contains fresh air channels leading to the cylinders. In addition, at least one suction module is provided, which is fastened to the cylinder head and which has a fresh air inlet opening and plurality of fresh air outlet openings fluidically connected to the fresh air channels.

Such a suction module can also be designated as a fresh air distributor and can come into use both in supercharged engines and also in aspirated engines. The suction module is attached onto the cylinder head and represents in this respect an attachment part. The cylinder head, which is attached to the engine block, represents here a flange component, which is provided on the engine block.

Usually, the suction module has a flange in the region of the fresh air outlet openings, which flange enables a screwed connection to the cylinder head. Depending on the configuration, a comparatively complex screw pattern can be present here. To realize the screwed connection, a hole pattern of the cylinder head must therefore be brought into overlap with a hole pattern of the flange, in order to be able to screw fastening screws through the through-holes of the flange into the screw holes of the cylinder head. In particular within a series assembly and preferably in connection with an automated screwed connection, a relatively great effort is necessary for this for the correct aligning of the suction module with respect to the cylinder head. Such an alignment takes place for example manually by a fitter.

Corresponding problems also occur in other attachment parts which must be attached to the engine block via a flange component.

SUMMARY

The present invention is concerned with the problem of indicating for an internal combustion engine of the type described above or respectively for an associated suction module an improved embodiment which is distinguished in particular by a simplified assembly of the internal combustion engine.

This problem is solved according to the invention by the subjects of the independent claim(s). Advantageous embodiments are the subject of the dependent claims.

The invention is based on the general idea of constructing on the attachment part, in particular on the suction module, and on the flange component, in particular on the cylinder head, an alignment device, which on attaching the attachment part to the flange component, in particular the suction module on the cylinder head, brings about an aligning of the attachment part relative to the flange component, in particular of the suction module relative to the cylinder head. The alignment device provided for this is preferably arranged between the attachment part and the flange component, therefore preferably the suction module and the cylinder head, so that it is situated on the one hand on an attachment side of the attachment part, in particular of the suction module, facing the flange component, preferably the cylinder head, and on the other hand on a connection side of the flange component, in particular of the cylinder head, facing the attachment part, preferably the suction module. On attaching the attachment part to the flange component, in particular the suction module to the cylinder head, the attachment side of the attachment part, preferably of the suction module, now comes to lie against the connection side of the flange component, preferably of the cylinder head, so that the alignment device provided between attachment part and flange component, in particular between suction module and cylinder head, can act and brings about the desired aligning of the attachment part relative to the flange component, in particular of the suction module relative to the cylinder head. Through the integration of such an alignment device into the attachment part and the flange component, in particular into the suction module and the cylinder head, during attaching of the attachment part, preferably of the suction module, necessarily and automatically the required alignment takes place with respect to the flange component, preferably the cylinder head, so that for example the above-mentioned hole pattern of the attachment part, in particular of the suction module, is aligned with sufficient accuracy in a congruent manner onto the hole pattern of the flange component, in particular of the cylinder head. The assembly of the attachment part, preferably of the suction module, is thereby simplified and in particular can be better automated.

The alignment device provided between attachment part and flange component, in particular between suction module and cylinder head, is provided here in addition to fastening means, which serve for fastening the attachment part to the flange component, in particular the suction module to the cylinder head. Such fastening means are, for example, screws for screwing the attachment part to the flange component, in particular the suction module to the cylinder head, which penetrate through through-openings provided on the attachment part, preferably on the suction module, and penetrate into screw openings of the flange component, preferably of the cylinder head. The alignment between attachment part and flange component, in particular between suction module and cylinder head, brought about by means of the alignment device, takes place here before the fastening of the attachment part to the flange component, in particular of the suction module to the cylinder head, therefore in particular before the above-mentioned screwed connection. In addition, the aligning takes place in an aligning plane which is oriented substantially perpendicularly to the attaching direction and which runs substantially parallel to the above-mentioned attachment side of the attachment part, preferably of the suction module, and parallel to the above-mentioned connection side of the flange component, preferably of the cylinder head, which lie against one another in the attached state.

Attachment parts in the sense of the present invention are, for example, suction modules, cylinder head covers, oil mist separators or coolers. Such attachment parts can have a greater extent in longitudinal direction than in transverse direction, whereby smaller deviations in the positioning can have a considerable effect over the entire extent of the component. The embodiments and example embodiments described in further detail below using the example of the suction module and the cylinder head, are transferable to the other attachment parts and flange components in an analogous manner.

According to an advantageous embodiment, the alignment device can have at least three separate alignment units arranged spaced apart from one another, wherein at least one such alignment unit brings about an aligning of the attachment part to the flange component or respectively of the suction module to the cylinder head with respect to a first aligning direction, which is oriented perpendicularly to an attaching direction, in which the attachment component is attached to the flange component or respectively in which the suction module is attached to the cylinder head. In addition, at least one other such alignment unit brings about an aligning of the attachment part to the flange component or respectively of the suction module to the cylinder head with respect to a second aligning direction, which is oriented perpendicularly to the attaching direction and inclined to the first aligning direction. Through the two aligning directions, running perpendicularly to the aligning direction and inclined to one another, an aligning plane is defined, which extends perpendicularly to the attaching direction. Expediently, the two aligning directions are oriented substantially perpendicularly to one another, so that the angle present between the two aligning directions has 90°±5°.

According to an advantageous embodiment, provision can be made that all the alignment units bring about an alignment of the attachment part to the flange component or respectively of the suction module to the cylinder head exclusively either in the first aligning direction or in the second aligning direction, so that only these two aligning directions are defined by means of the alignment units. Hereby, a particularly simple and efficient positioning or respectively alignment is achieved between attachment part and flange component or respectively between suction module and cylinder head.

An embodiment is particularly advantageous in which precisely three alignment units are provided, wherein two of these alignment units, therefore a first alignment unit and a second alignment unit, bring about an alignment in the one aligning direction, whereas one of these alignment units, therefore the third alignment unit, brings about an alignment in the other aligning direction. For example, the first and second alignment unit bring about respectively an alignment in the first aligning direction, whereas the third alignment unit brings about an alignment in the second aligning direction, or vice versa.

According to a particularly advantageous further development, provision can be made that the two alignment units associated with the one aligning direction, therefore the first and second alignment unit, are spaced apart from one another in the other aligning direction. Additionally or alternatively, provision can be made that the one alignment unit associated with the other aligning direction, therefore the third alignment unit, is arranged with respect to this aligning direction between the two alignment units associated with the one aligning direction, therefore between the first and the second alignment unit. Furthermore, additionally or alternatively, provision can be made that the one alignment unit (third alignment unit) associated with the other aligning direction is arranged in the one aligning direction offset to the two alignment units (first and second alignment unit) associated with the one aligning direction. The above-mentioned provisions can be realized respectively individually or jointly or in any desired combination and bring about respectively an improved alignment of the attachment part with respect to the flange component or respectively of the suction module with respect to the cylinder head. Furthermore, provision can be made that the one alignment unit, which is associated with the other aligning direction, therefore the third alignment unit, is arranged substantially centrally between the first and the second alignment unit, therefore between the two other alignment units, which are associated with the one aligning direction. This central alignment refers here to a longitudinal direction of the attachment part or respectively of the flange component, or respectively of the suction module or of the cylinder head and corresponds in particular to the direction in which the cylinders of the cylinder head are arranged adjacent to one another. The aligning direction associated with the centrally arranged (third) alignment unit extends preferably parallel to the above-mentioned longitudinal direction.

According to another advantageous embodiment, the alignment units can have respectively a first alignment element, securely arranged on the attachment component or respectively on the suction module, and a second alignment element securely arranged on the flange component or respectively on the cylinder head, which interact for the aligning of the attachment part relative to the flange component or respectively of the suction module relative to the cylinder head in the respective aligning direction. An embodiment is preferred here in which the first alignment elements are formed integrally on the attachment part or respectively on the suction module. Additionally or alternatively, the second alignment elements can be formed integrally on the flange component or respectively on the cylinder head.

According to a further development, at least in an alignment unit the first alignment element can be formed by an alignment pin projecting from the attachment part or respectively from the suction module in the attaching direction, whilst the associated second alignment element is formed by an aligning opening formed in the flange component or respectively in the cylinder head, into which aligning opening the alignment pin engages for the aligning of the attachment part to the flange component or respectively of the suction module to the cylinder head. Additionally or alternatively, provision can be made that at least in an alignment unit the second alignment element is formed by an alignment pin projecting from the flange component or respectively from the cylinder head in the attaching direction, whereas the associated first alignment element is formed by an aligning opening formed in the attachment part or respectively in the suction module, into which aligning opening the alignment pin engages for the aligning of the attachment part to the flange component or respectively of the suction module to the cylinder head. The associated alignment elements of the respective alignment unit therefore interact through a form-fitting engagement and thereby bring about an efficient alignment of the attachment part relative to the flange component or respectively of the suction module relative to the cylinder head.

Basically, provision can be made that in all alignment units the first alignment element is formed by an alignment pin. Alternatively, provision can be made that in all alignment units the first alignment element is formed by an aligning opening. Basically, however, a mixed embodiment is also conceivable, so that at least one alignment pin and at least one aligning opening are present on the attachment part or respectively on the suction module. However, an embodiment is preferred in which all the alignment pins are provided on the attachment part or respectively on the suction module, wherein here an integral forming of the alignment pints on the attachment part or respectively on the suction module is preferred.

According to an advantageous further development, at least one such aligning opening can be configured as an elongated hole, the longitudinal direction of which runs perpendicularly to the respective aligning direction of the associated alignment unit. Preferably, all the aligning openings are configured as an elongated hole.

Furthermore, provision can be made that at least one such aligning opening is configured in an elongate manner or as an elongated hole, and has between its longitudinal ends a guide portion which has two wall portions lying opposite one another, which extend parallel to one another and perpendicularly to the respective aligning direction of the associated alignment unit. Expediently, the associated alignment pin, which engages into this elongate alignment opening, can be guided on the said wall portions. The alignment pin can have a circular cross-section for example transversely to the attaching direction. However, this is not obligatorily necessary.

Preferably, all the aligning openings are designed so as to be elongate or respectively as an elongated hole.

According to another advantageous further development, at least one such aligning opening can have a circular cross-section perpendicularly to the attaching direction. An embodiment is also preferred here in which all the aligning openings have such a circular cross-section. However, a mixed embodiment is also conceivable, in which at least one aligning opening has such a circular cross-section, whereas at least one other aligning opening is configured so as to be elongate or as an elongated hole.

In so far as in the respective alignment unit the aligning opening has a circular cross-section, according to an advantageous embodiment the associated alignment pin can have perpendicularly to the attaching direction a pin cross-section which has a pin width parallel to the aligning direction of the associated alignment unit which is greater than a pin thickness running parallel to the respectively other aligning direction. Expediently, the pin width extends here perpendicularly to the pin thickness. As the pin cross-sections have a greater pin width than pin thickness, the respective alignment pin defines within the circular aligning opening the associated aligning direction, because parallel to the pin thickness a greater play is present for the alignment pin within the aligning opening, so that the alignment takes place parallel to the pin width.

A further development is particularly advantageous, in which the pin cross-section is flat, so that a portion with constant pin thickness is present along the pin width between end portions, which are spaced apart from one another in a pin width direction.

Additionally or alternatively, for the case where the respective alignment unit has an aligning opening with circular cross-section, the associated alignment pin can be designed so that it has a smaller bending stiffness perpendicularly to the respective aligning direction of the associated alignment unit than parallel to this aligning direction. Therefore, during the aligning of the attachment part or respectively of the suction module with respect to the flange component or respectively the cylinder head, a bending deformation, preferably an elastic bending deformation, of the alignment pin can take place, whereby parallel to the greater bending stiffness and alignment takes place between attachment part and flange component or respectively between suction module and cylinder head.

In so far as the pin cross-section is flat, the smaller bending stiffness occurs perpendicularly to the relatively small pin thickness, whereas perpendicularly to the relatively large pin width a correspondingly greater bending stiffness is present. In particular, provision can then be made that the pin width corresponds substantially to the diameter of the circular aligning opening, whereby the aligning takes place parallel to the pin width, whereas transversely thereto, therefore in the pin thickness, a certain mobility of the alignment pin is still present within the aligning opening, namely in particular through the smaller bending stiffness in this direction.

According to an advantageous embodiment, all the alignment units can lie in one aligning plane, in which the attachment part lies against the flange component or respectively the suction module lies against the cylinder head. Hereby, the aligning between attachment part and flange component, or respectively between suction module and cylinder head is simplified.

An embodiment is preferred, in which the flange component is a cylinder head which is fastened to the engine block and contains fresh air channels leading to the cylinders. In addition, the attachment part can be a suction module which is fastened to the cylinder head and which has a fresh air inlet opening and a plurality of fresh air outlet openings fluidically connected to the fresh air channels.

A suction module according to the invention, which is suitable for an internal combustion engine of the type described above, has on an attachment side, provided for the attaching of the suction module onto the cylinder head, a plurality of first alignment elements arranged securely thereon. Additionally or alternatively, the suction module can have a module housing on which, on an attachment side provided for the attaching of the suction module onto the cylinder head, a plurality of first alignment elements are integrally formed. The first alignment elements provided on the suction module or respectively on the module housing can preferably be, as explained above, alignment pins and/or aligning openings.

Further important features and advantages of the invention will emerge from the subclaims, from the drawings and from the associated figure description with the aid of the drawings, wherein in the drawings the attachment part is configured by way of example as a suction module, whilst the flange component is configured by way of example as a cylinder head.

It shall be understood that the features mentioned above and to be explained further below are able to be used not only in the respectively indicated combination, but also in other combinations or in isolation, without departing from the scope of the present invention.

Preferred example embodiments of the invention are illustrated in the drawings and are explained further in the following description, wherein the same reference numbers refer to identical or similar or functionally identical components.

BRIEF DESCRIPTION OF THE DRAWINGS

There are shown, respectively diagrammatically.

DETAILED DESCRIPTION OF THE DRAWINGS

Figure 1:
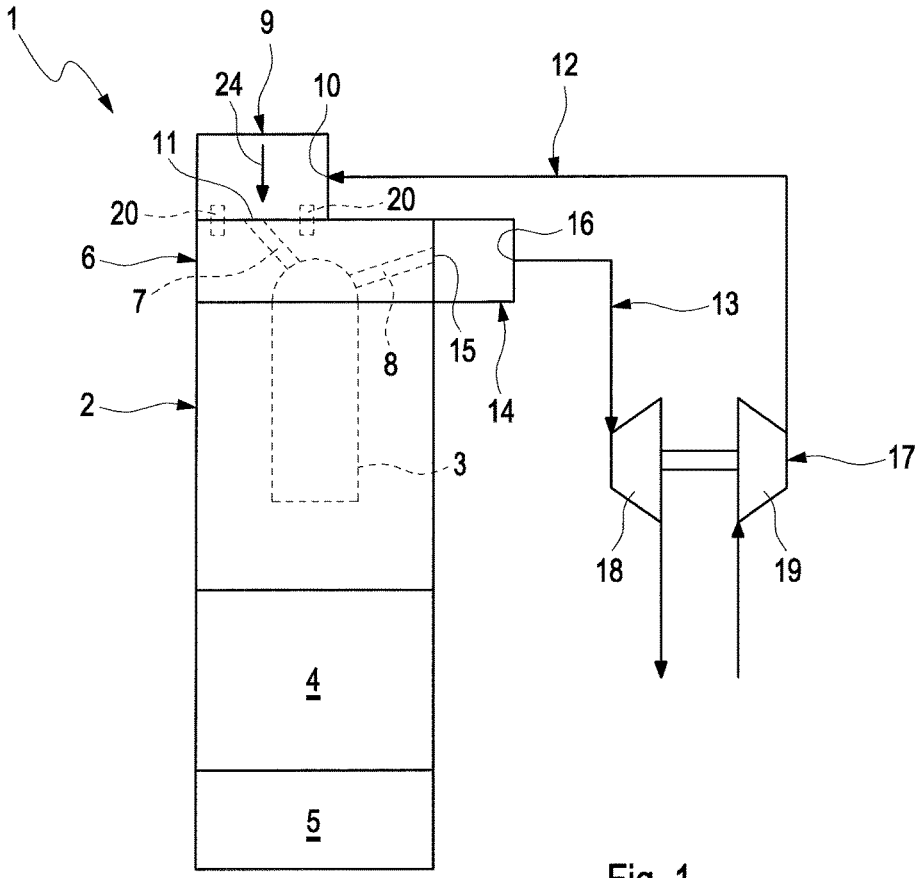
FIG. 1 illustrates a greatly simplified schematic diagram in the manner of a circuit diagram of an internal combustion engine.

According to FIG. 1, an internal combustion engine 1 comprises at least one engine block 2, in which a plurality of cylinders 3 are arranged, of which, however, only one is indicated in FIG. 1 by a broken line. In FIG. 1, a crankcase 4 adjoins beneath the engine block 2, on the underside of which crankcase an oil sump 5 is arranged. Above, a cylinder head 6 adjoins the engine block 2, which cylinder head contains fresh air channels 7 leading to the cylinders 3, of which only one can be seen in FIG. 1 and is indicated by a broken line. In addition, the cylinder head 6 contains exhaust gas channels 8 for the cylinders 3, of which exhaust gas channels likewise only one can be seen in FIG. 1 and is indicated by a broken line. Further components which are usually present in an internal combustion engine 1, such as crankshaft, piston, connecting rod, gas exchange valves and valve control and injection device, are not illustrated, so as to maintain clarity. In addition, in the example of FIG. 1, the internal combustion engine 1 is configured as an in-line engine, which has only one engine block 2 and only one cylinder head 6. Basically, structural forms are also conceivable, in which at least two engine blocks 2 and/or at least two cylinder heads 6 are present. For example, in an internal combustion engine 1 configured as a V-engine, two cylinder heads 6 can be provided, and in an internal combustion engine 1 configured as a boxer engine, in addition two engine blocks 2 can be provided. The cylinder head 6 represents a flange component of the engine block 2.

The internal combustion engine 1 has in addition at least one suction module 9, which is fastened to the cylinder head 6 in a suitable manner and which has a fresh air inlet opening 10 and a plurality of fresh air outlet openings 11 fluidically connected to the fresh air channels 7. The suction module 9 forms here a component of a fresh air system 12, which serves for supplying the cylinders 3 with fresh air. The suction module 9 serves as fresh air distributor, which distributes the fresh air to the individual cylinders 3. The suction module 9 represents an attachment part, which is attached to the cylinder head 6 serving as flange component.

Furthermore, the internal combustion engine 1 is configured with an exhaust system 13, which has an exhaust manifold 14. The exhaust manifold 14 is fastened to the cylinder head 6 and has a plurality of exhaust gas inlet openings 15, which are fluidically connected to the exhaust gas channels 8, and has an exhaust gas outlet opening 16. In the example which is shown, the internal combustion engine 1 is designed as a supercharged internal combustion engine 1 and is provided, for this, with a charging device, which is designed here as an exhaust gas turbocharger 17. The exhaust gas turbocharger 17 has a turbine 18, which is integrated into the exhaust system 13, and a compressor 19, which is integrated into the fresh air system 12. During operation of the internal combustion engine 1, the turbine 18 drives the compressor 19 in a conventional manner In the internal combustion engine 1 which is presented here, an alignment device 20 is provided between the suction module 9 and the cylinder head 6, which alignment device is indicated by a broken line in FIG. 1. It serves for aligning the suction module 9 relative to the cylinder head 6 on attaching the suction module 9 to the cylinder head 6. The alignment device 20 is provided here in addition to fastening means which are not shown in further detail here, which serve for fastening the suction module 9 to the cylinder head 6. Of these fastening means, in the view of FIG. 3 through-openings 21 can be seen, which are formed on the suction module 9 and through which fastening screws, which are not shown here, are guided in order to screw the suction module 9 to the cylinder head 6.

Figure 2:
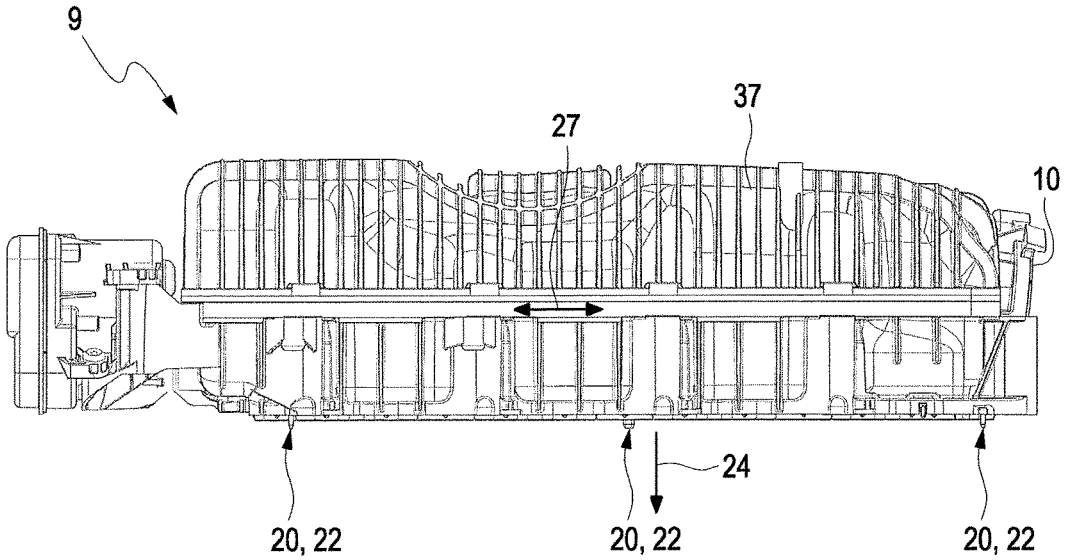
FIG. 2 illustrates a side view of a suction module.
Figure 3:
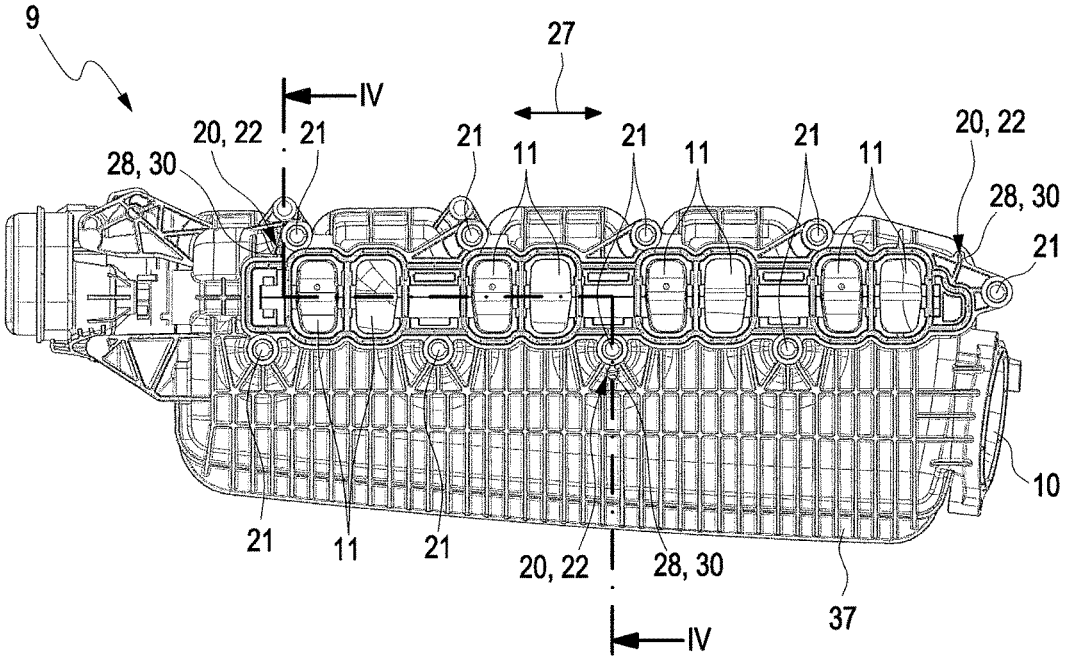
FIG. 3 illustrates a view of the suction module from below.
Figure 4:
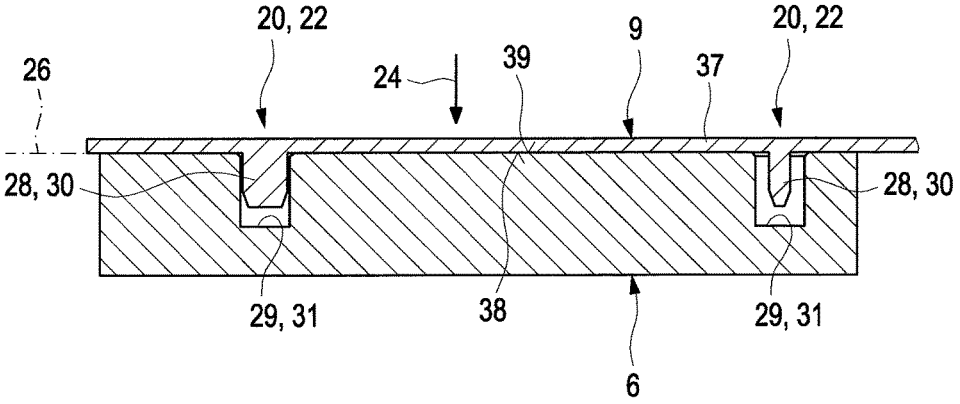
FIG. 4 illustrates a simplified sectional view of the internal combustion engine in the region of an alignment device analogous to an angled section line IV-IV indicated in FIG. 3.

According to FIGS. 2 to 6, the alignment device 20 has at least three separate alignment units 22, which are arranged spaced apart from one another. According to FIGS. 5 and 6, which represent a schematization of the alignment device 20, two such alignment units 22 are designed so that they bring about an aligning of the suction module 9 with respect to the cylinder head 6 with regard to a first aligning direction 23, which runs vertically in FIGS. 5 and 6. The first aligning direction 23 is, in addition, oriented perpendicularly to an attaching direction 24, which is indicated in FIGS. 1, 2 and 4 by a vertical arrow and in which the suction module 9 is attached to the cylinder head 6. These two alignment units 22 are arranged on the left or respectively right in FIGS. 2, 3, 5 and 6 and can be designated below also as first or left or respectively as second or right alignment unit 22.

The remaining other alignment unit 22, on the other hand, is designed so that it brings about an aligning of the suction module 9 relative to the cylinder head 6 with regard to a second aligning direction 25, which is likewise oriented perpendicularly to the attaching direction 24 and in addition is inclined to the first aligning direction 23. In the example, this second aligning direction 25 is oriented substantially perpendicularly to the first aligning direction 23 and runs accordingly horizontally in FIGS. 5 and 6. The first aligning direction 23 and the second aligning direction 25 define an aligning plane 26, which is indicated in FIG. 4 and which runs substantially perpendicularly to the attaching direction 24. This other alignment unit 22 is arranged centrally in FIGS. 2, 3, 5 and 6 and can also be designated below as third or central alignment unit 22.

In the preferred examples shown here, precisely three such alignment units 22 are provided, which all bring about either an aligning in the first aligning direction 23 or in the second aligning direction 25. The variant shown here is preferred, in which two alignment units 22, namely the first and second alignment unit 22 respectively bring about an aligning in the first aligning direction 23, whereas only one alignment unit 22, namely the third alignment unit 22, brings about an aligning in the second aligning direction 25. The two first and second alignment units 22 associated with the first aligning direction 23 are arranged spaced apart from one another here in the second aligning direction 25. In addition, the third or central alignment unit 22 associated with the second aligning direction 25 is arranged with regard to the second aligning direction 25 between the two left and right alignment units 22 associated with the first aligning direction 23. In addition, the third alignment unit 22 associated with the second aligning direction 25 is arranged offset in the first aligning direction 23 to the two first and second alignment units 22 associated with the first aligning direction 23. Furthermore, provision is made here that the third alignment unit 22, associated with the second aligning direction 25, is arranged with regard to a longitudinal direction 27 of the suction module 9 centrally between the two first and second alignment units 22 associated with the first aligning direction 23. The longitudinal direction 27 of the suction module 9 is indicated in FIGS. 2, 3, 5 and 6 respectively by a double arrow and extends parallel to a direction in which the individual cylinders 3 of the engine block 2 are arranged adjacent to one another in the engine block 2. This longitudinal direction 27 runs in FIG. 1 perpendicularly to the plane of the drawing. The second aligning direction 25 runs here parallel to the longitudinal direction 27 of the suction module 9.

The individual alignment units 22 have respectively a first alignment element 28 arranged securely on the suction module 9 and a second alignment element 29 arranged securely on the cylinder head 6. The one of the two alignment elements 28, 29 is configured as alignment pin 30 in the examples which are shown here, whereas the respectively other alignment element 28, 29 is configured here as aligning opening 31, into which the associated alignment pin 30 engages for aligning the suction module 9 to the cylinder head 6. In the preferred embodiments shown here, respectively the first alignment element 28 formed on the suction module 9 is formed by such an alignment pin 30, whereas the second alignment element 29 formed on the cylinder head 6 is formed respectively by such an aligning opening 31.

Figure 5:
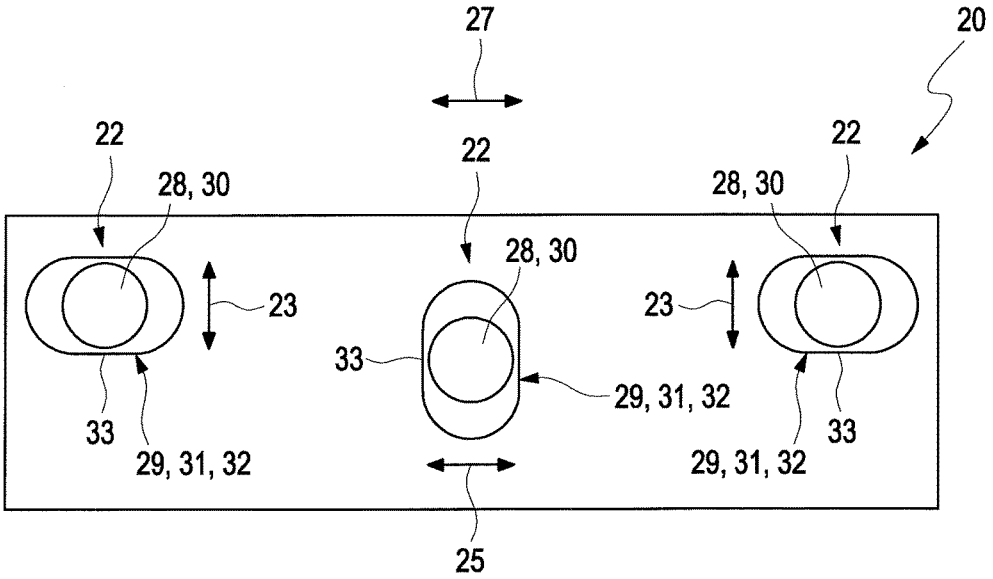
FIG. 5 illustrates a greatly simplified schematic diagram of the alignment device.

In the embodiment shown in FIG. 5, the respective aligning opening 31 is configured so as to be elongate or respectively is formed by an elongated hole 32. The longitudinal direction of the respective elongated hole 32 extends here perpendicularly to the aligning direction 23, 25, which is associated with the respective alignment unit 22. In addition, the elongate aligning opening 31 has between its longitudinal ends a guide portion 33, which is defined by two wall portions lying opposite one another, running parallel to one another. These wall portions extend here perpendicularly to the aligning direction 23, 25, which is associated with the respective alignment unit 22. Therefore, the guide portion 33 defines the aligning direction 23, 25 of the respective alignment unit 22. The associated alignment pin 30 is now guided in the said guide portion 33 on the said wall portions, such that the respective alignment pin 30 in the respective elongate aligning opening 31 with respect to the aligning direction 23, 25 which is associated with this alignment unit 22, is centred in the aligning opening 31, whereas perpendicularly thereto, therefore in the respectively other aligning direction 23, 25, it is movable within the elongate aligning opening 31. In particular, the alignment pin 30, associated with the elongate aligning openings 31, can have a circular cross-section, as in the example of FIG. 5, perpendicularly to the attaching direction 24.

Figure 6:
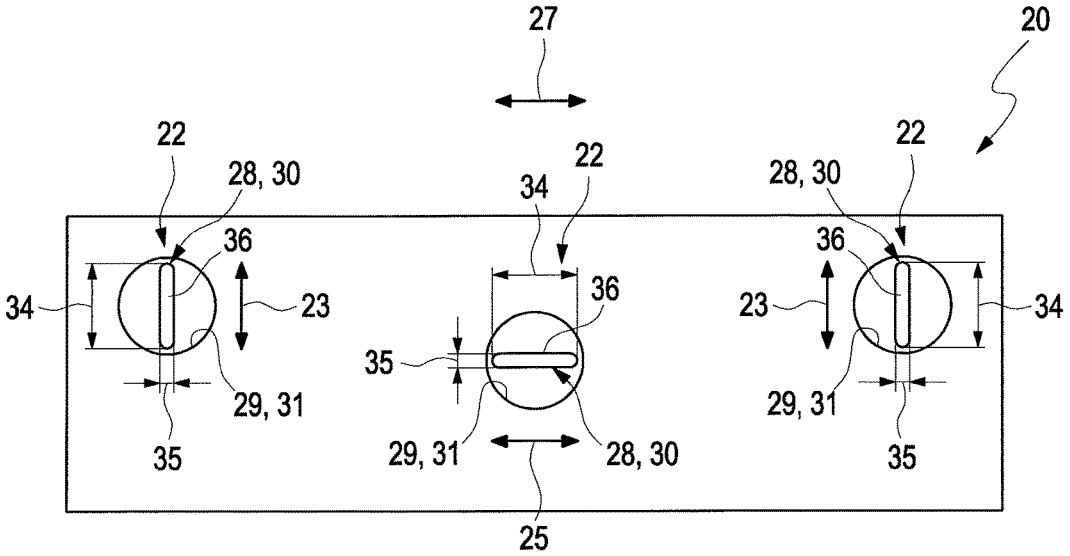
FIG. 6 illustrates a view as in FIG. 5, but in a different embodiment.

In FIG. 6 another embodiment is explained in further detail, which is also realized in the example of FIGS. 2 to 4. This embodiment is distinguished by being able to be produced at a particularly economical price. It is characterized in that the aligning openings 31 have respectively a circular cross-section perpendicularly to the attaching direction 24. The associated alignment pins 30 are configured so that they have a smaller bending stiffness perpendicularly to the aligning direction 23, 25, which is associated with the respective alignment unit 22, than parallel to this aligning direction 23, 25, which is associated with the respective alignment unit 22. For example, in the first alignment unit 22 shown on the left in FIG. 6, the first aligning direction 23 is provided. The associated alignment pin 30 is then equipped with a smaller bending stiffness in the second aligning direction 25 than in the first aligning direction 23. The same also applies to the second alignment unit 22 shown on the right in FIG. 6. The reverse conditions occur, however, with the third alignment unit 22 illustrated centrally in FIG. 6.

Direction-dependent bending stiffnesses are achieved here in that the associated alignment pin 30 has perpendicularly to the attaching direction 24 a pin cross-section which, parallel to the aligning direction 23, 25 which is allocated to the associated alignment unit 22, has a pin width 34 which is greater than a pin thickness 35, which runs parallel to the respectively other aligning direction 23, 25. In practical terms in the example shown in FIG. 6, with the first alignment unit 22 shown on the left, the pin width 34 is oriented parallel to the first aligning direction 23 and is dimensioned considerably greater than the associated pin thickness 35, which is oriented parallel to the second aligning direction 25. The same then also applies to the second alignment unit 22 illustrated on the right in FIG. 6. On the other hand, with the third alignment unit 22, shown centrally in FIG. 6, the orientations of pin width 34 and pin thickness 35 are reversed.

In the preferred example, the respective pin cross-section is flat, such that the pin cross-section along the pin width 34 between end portions, not designated in further detail, which are spaced apart from one another in the pin width direction, has a portion 36 in which the pin thickness 35 is constant.

Expediently, e.g. according to FIG. 4, all alignment units 22 lie here in the above-mentioned aligning plane 26, in which in the assembled state an attachment side 38 of the suction module 9, facing the cylinder head 6, lies against a connection side 39 of the cylinder head 6 facing the suction module 9.

The suction module 9 has expediently a module housing 37, on which the air inlet opening 10 and the air outlet openings 11 are formed. Here, also, the attachment side 38 is situated on this module housing 37. In addition, the through-openings 21 of the fastening means, not shown in further detail, are formed on the module housing 37.

The invention claimed is:

1. An internal combustion engine comprising:

at least one engine block including a plurality of cylinders and at least one flange component;

at least one attachment part secured to the at least one flange component;

an alignment device constructed and arranged to align the at least one attachment part relative to the at least one flange component when the at least one attachment part is attached to the at least one flange component;

the alignment device including at least a first alignment unit, a second alignment unit, and a third alignment unit, spaced apart from one another;

wherein at least one of the first alignment unit, the second alignment unit, and the third alignment unit are constructed and arranged to align the at least one attachment part to a cylinder head in relation to a first aligning direction that is oriented perpendicularly to an attaching direction when the at least one attachment part is attached to the cylinder head;

wherein at least one other of the first alignment unit, the second alignment unit, and the third alignment unit is constructed and arranged to align the at least one attachment part to the cylinder head in relation to a second aligning direction that is oriented perpendicularly to the attaching direction and inclined to the first aligning direction; and wherein each of the first alignment unit, the second alignment unit, and the third alignment unit are respectively constructed and arranged to align the at least one attachment part to the cylinder head exclusively in one of the first aligning direction and in the second aligning direction.

2. The internal combustion engine according to claim 1, wherein the first aligning direction is oriented substantially perpendicularly to the second aligning direction.

3. The internal combustion engine according to claim 1, wherein only the first alignment unit, the second alignment unit, and the third alignment unit are provided, and wherein two of the first alignment unit, the second alignment unit, and the third alignment unit are constructed and arranged to align the at least one attachment part to the cylinder head in one of the first aligning direction and the second aligning direction and one other of the first alignment unit, the second alignment unit, and the third alignment unit is constructed and arranged to align the at least one attachment part to the cylinder head in the other of the first aligning direction and the second aligning direction.

4. The internal combustion engine according to claim 3, wherein the first alignment unit and the second alignment unit align the at least one attachment part in the first aligning direction and are spaced apart from one another in the second aligning direction, and the third alignment unit aligns the at least one attachment part in the second aligning direction and is arranged between the first alignment unit and the second alignment unit with respect to the second aligning direction, and wherein the third alignment unit is arranged offset to the first alignment unit and the second alignment unit with respect to the first aligning direction.

5. The internal combustion engine according to claim 1, wherein at least one of the first alignment unit, the second alignment unit, and the third the alignment unit each further include a first alignment element secured to the at least one attachment part, and a second alignment element secured to the cylinder head, the first alignment element and the second alignment element constructed and arranged to interact together for aligning the at least one attachment part in the respective aligning direction.

6. The internal combustion engine according to claim 5, wherein the first alignment element of the at least one of the first alignment unit, the second alignment unit, and the third alignment unit includes an alignment pin extending from the at least one attachment part in the attaching direction, and the second alignment element has an aligning opening defined in the cylinder head, and wherein the aligning opening is constructed and arranged to engage the alignment pin to align the at least one attachment part to the cylinder head.

7. The internal combustion engine according to claim 5, wherein the second alignment element of the at least one of the at least first alignment unit, the second alignment unit, and the third alignment unit includes an alignment pin extending from the cylinder head in the attaching direction, and the first alignment element has an aligning opening defined in the at least one attachment part, constructed and arranged to engage with the alignment pin to align the at least one attachment part to the cylinder head.

8. The internal combustion engine according to claim 6, wherein the aligning opening is an elongated hole having a longitudinal direction running perpendicularly to the respective aligning direction of the associated alignment unit, and wherein the alignment pin is centered in the elongated hole of the aligning opening and movable in the longitudinal direction.

9. The internal combustion engine according to claim 6, wherein the aligning opening has an elongated shape and defines a guide portion between a first longitudinal end and a second longitudinal end, and wherein the guide portion includes a first wall portion and a second wall portion opposite of the first wall portion, wherein the first wall portion and the second wall portion extend parallel to one another and perpendicularly to the respective aligning direction of the associated alignment unit.

10. The internal combustion engine according to claim 6, wherein the aligning opening defines a circular cross-section perpendicular to the attaching direction, and the associated alignment pin defines a pin cross-section perpendicular to the attaching direction, and includes a pin width parallel to the aligning direction of the associated alignment unit, and wherein the pin width is greater than a pin thickness running parallel to the respective other aligning direction such that the alignment pin is movable in a pin thickness direction.

11. The internal combustion engine according to claim 10, wherein the pin cross-section is flat and includes a portion with a constant pin thickness along the pin width between two end portions of the alignment pin that are spaced apart from one another in a pin width direction.

12. The internal combustion engine according to claim 6, wherein the aligning opening has a circular cross-section perpendicular to the attaching direction; and the alignment pin extending perpendicularly to the respective aligning direction of the associated alignment unit has a smaller bending stiffness than in a direction parallel to the respective aligning direction.

13. The internal combustion engine according to claim 1, wherein the first alignment unit, the second alignment unit, and the third alignment unit lie in an aligning plane defined where the at least one attachment part lies against the cylinder head.

14. The internal combustion engine according to claim 1, wherein the at least one flange component is a portion of the cylinder head secured to the engine block, the cylinder head including a plurality of fresh air channels leading to the plurality of cylinders; and wherein the at least one attachment part is a suction module secured to the cylinder head and includes a fresh air inlet opening and a plurality of fresh air outlet openings in fluid communication with the plurality of fresh air channels.

15. A suction module for an internal combustion engine according to claim 5, wherein the suction module includes an attachment side constructed and arranged to attach the suction module to the cylinder head, and a plurality of first alignment elements disposed on the attachment side.

16. A suction module for an internal combustion engine according to claim 5, wherein the suction module comprises a module housing having an attachment side constructed and arranged to attach the suction module to the cylinder head, and wherein the attachment side comprises a plurality of first alignment elements disposed on the attachment side.

17. The suction module according to claim 16, wherein the plurality of first alignment elements are secured to the attachment side.

18. The internal combustion engine of claim 1, wherein the first alignment unit is positioned on a first end of the alignment device and the second alignment unit is positioned on a second end of the alignment device opposite of the first alignment device, and the third alignment unit is positioned central of the alignment device.

19. The internal combustion engine of claim 1, wherein the first alignment unit and the second alignment unit align the at least one attachment part in the first aligning direction and are spaced apart from one another in the second aligning direction, and the third alignment unit aligns the at least one attachment part in the second aligning direction and is arranged between the first alignment unit and the second alignment unit with respect to the second aligning direction; and wherein the first alignment unit, the second alignment unit, and the third alignment unit respectively include an alignment pin that engages into an aligning opening, wherein one of the alignment pin and the aligning opening has an aligning direction-dependent structure of an elongated hole or an elongated pin width, respectively.

20. The internal combustion engine of claim 19, wherein one of:

the alignment pin has the aligning direction-dependent structure of the elongated pin width and the aligning opening has a circular cross-section, wherein the elongated pin width extends parallel to the respective one of the first aligning direction and the second aligning direction of the associated alignment unit such that the alignment pin is moveable in the other of the first aligning direction and the second aligning direction; and the aligning opening has the aligning direction-dependent structure of the elongated hole and the alignment pin has a circular cross-section, wherein the elongated hole extends perpendicularly to the respective one of the first aligning direction and the second aligning direction of the associated alignment unit, and wherein the alignment pin is movable within the elongated hole of the aligning opening in the respective one of the first aligning direction and the second aligning direction of the associated alignment unit.

* * * * *